US009562311B2

(12) United States Patent
Cho

(10) Patent No.: US 9,562,311 B2
(45) Date of Patent: Feb. 7, 2017

(54) WASHING MACHINE HAVING UPPER AND LOWER WASH TUBS CONNECTED BY A ROTATION CONVERSION UNIT

(71) Applicant: Dongbu Daewoo Electronics Corporation, Seoul (KR)

(72) Inventor: Jun Sik Cho, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 248 days.

(21) Appl. No.: 14/137,689

(22) Filed: Dec. 20, 2013

(65) Prior Publication Data

US 2015/0135777 A1 May 21, 2015

(30) Foreign Application Priority Data

Nov. 21, 2013 (KR) ..... 10-2013-0142196

(51) Int. Cl.

| | |
|---|---|
| ***D06F 37/30*** | (2006.01) |
| ***D06F 37/26*** | (2006.01) |
| ***D06F 39/12*** | (2006.01) |
| ***D06F 31/00*** | (2006.01) |

(52) U.S. Cl.

CPC ..... *D06F 31/00* (2013.01); *D06F 37/26* (2013.01); *D06F 37/30* (2013.01); *D06F 39/12* (2013.01)

(58) Field of Classification Search

CPC ..... D06F 31/00; D06F 37/26; D06F 37/30; D06F 39/12; D06F 17/04; D06F 37/145

USPC ..... 68/27, 11, 5 C, 9

See application file for complete search history.

(56) References Cited

U.S. PATENT DOCUMENTS

| | | | | |
|---|---|---|---|---|
| 2,570,529 | A * | 10/1951 | Dolan | D06F 18/00 68/103 |
| 3,555,701 | A * | 1/1971 | Hubbard | D06F 58/02 34/602 |
| 2009/0145174 | A1* | 6/2009 | Kim | D06F 23/02 68/27 |
| 2010/0294004 | A1* | 11/2010 | Hu | D06F 29/00 68/13 R |
| 2011/0041258 | A1* | 2/2011 | Ko | D06F 29/00 8/137 |
| 2011/0041560 | A1* | 2/2011 | Lee | D06F 39/125 68/9 |
| 2012/0234054 | A1* | 9/2012 | Kim | D06F 17/04 68/5 C |

FOREIGN PATENT DOCUMENTS

| | | |
|---|---|---|
| CN | 2451622 Y | 10/2001 |
| KR | 20-1991-18339 | 11/1991 |
| KR | 10-2004-0009399 | 1/2004 |
| KR | 10-2008-0109488 | 12/2006 |
| KR | 10-070132 | 3/2007 |
| KR | 10-2010-0106553 | 10/2010 |

* cited by examiner

*Primary Examiner* — Michael Barr
*Assistant Examiner* — Rita Adhlakha

(57) ABSTRACT

A dual washing machine includes a front-loading tub and a top-loading tub in a main body and/or case. The front-loading tub is tub is at or in a lower portion of the main body and/or case, and the top-loading tub is at or in an upper portion of the main body and/or case.

18 Claims, 5 Drawing Sheets

WASHING MACHINE HAVING UPPER AND LOWER WASH TUBS CONNECTED BY A ROTATION CONVERSION UNIT

CROSS-REFERENCE TO RELATED APPLICATIONS

This application is based on and claims priority from Korean Patent Application No. 10-2013-0142196, filed on Nov. 21, 2013, the disclosure of which is incorporated herein in its entirety by reference.

TECHNICAL FIELD

The present disclosure relates to a washing machine, and more particularly, to a dual washing machine having a general type tub and a drum type tub in a main body and/or case.

BACKGROUND

In general, a washing machine refers to a mechanical apparatus that cleans and quickly washes contaminants from dirty laundry such as clothes or bedclothes using a detergent emulsion and frictional action of washing water that flows from rotational motion and/or impact action with the laundry, and the like.

In accordance with a washing manner, the washing machine may be classified into (i) a pulsator type (e.g., a rotating laundry plate type) washing machine that uses a water current formed by rotating a rotating wing or pulsator at a bottom of the tub, (ii) an agitator type (e.g., rod washing type) washing machine that washes the laundry by rotating a washing rod or cylinder having a rotating wing at a center of a tub, and (iii) a drum type (e.g., cylinder type) washing machine that washes the laundry using a force that occurs when the laundry falls in the drum by rotating the drum.

The pulsator type washing machine and the agitator type washing machine have excellent cleaning power because the laundry may be washed in a short time. However, the clothes may become tangled and damaged. The drum washing machine of the present disclosure resolves such a drawback.

In addition to a principle of an electric washing machine, the drum type washing machine washes the laundry using a force that occurs when the laundry is raised by a lifter, and then falls by rotating the drum. The advantages include less damage to the clothing since there is less friction, and a minimal amount of water is used because water is needed only at the bottom of the drum.

The drum washing operation may wash the laundry using friction between the laundry and the rotating drum by receiving a drive power from a motor. As a result, the clothes may not become tangled, thus minimizing damage to the clothing.

However, despite the advantages that the drum washing machine uses less water and provides effective washing power, the drum type washing machine requires a motor for generating strong drive power in order to rotate the tub, and therefore, the drum type washing machine consumes a large amount of electric power in comparison with a general type washing machine.

In general, white clothes and black or colored clothes are often separately washed in order to prevent color bleeding.

When the laundry is washed in this manner, more energy and resource are consumed. Since the clothes may need to be stored for a long period of time before washing, a space for storing the laundry is required, and an odor may occur from the stored laundry.

A family with a baby generally washes the baby's clothes separately and more frequently. As a result, a small scale washing machine may be useful to wash the baby's clothes. Therefore, an additional cost and space are required to purchase and install the small scale washing machine.

Because the general type washing machine and the drum type washing machine have advantages and drawbacks, respectively, consumers may wish to have both the general type washing machine and the drum type washing machine. However, when the consumer buys two washing machines, additional cost and space are required.

SUMMARY

The present disclosure has been made in an effort to provide a washing machine capable of simultaneously washing laundry that may need to be independently washed, without requiring a specific time interval.

The present disclosure has been made in an effort to provide a washing machine capable of washing laundry with a specific and/or elected option after a user selects a desired washing option from a plurality of washing options.

To this end, the washing machine according to the present disclosure comprises a dual washing machine having a general type tub and a drum type tub that includes a main body and/or case, the drum type tub being at a lower portion of the main body and/or case, and the general type tub being at an upper portion of the main body and/or case.

The dual tub washing machine according to the present disclosure includes a motor configured to transmit rotational force; a rotation conversion unit configured to convert rotation in a first direction to an orthogonal direction (e.g., alone or orthogonal to a rotation shaft of the motor); a vertical rotation shaft configured to rotate by the rotation conversion unit; and a power transmission unit that is connected to the vertical rotation shaft and that rotates a rotation shaft of the general type tub.

The rotation conversion unit includes a ring gear on a central shaft connected to the motor, a first gear attached to one side of the ring gear, a second gear connected to the rotation shaft, and configured to be rotated by the first gear, and a pinion gear coupled to the ring gear, configured to be rotated in an orthogonal direction to the rotation shaft.

The washing machine according to the present disclosure may include a motor configured to transmit rotational force; a first rotation conversion unit that converts a rotation in a first direction into a rotation orthogonal to a rotation shaft of the motor (e.g., the first direction); a second rotation conversion unit that converts a rotation in a second direction into a rotation orthogonal to a rotation shaft of the general type tub (e.g., the second direction); and a third rotation conversion unit that converts a rotation direction of the first rotation conversion unit into a rotation in a direction of the second rotation conversion unit (e.g., the third direction). The first, second, and third rotation conversion units may comprise a bevel gear.

The washing machine according to the present disclosure includes a first control panel that controls a general washing operation, and that is on an upper surface of the main body and/or case, and a second control panel that controls a drum washing operation, and that is on a front surface of an upper portion of the main body and/or case.

The washing machine according to the present disclosure may alternatively include a single control panel that controls the general washing operation and the drum washing operation. The single control panel may be on the main body and/or case.

As described above, the washing machine according to the present disclosure has the general type tub and the drum type tub. A user may select a washing option or may simultaneously use two different washing options depending on the type of laundry, thereby maximizing washing productivity.

As a result, it is not necessary to wash white and colored clothing one at separate times, thereby reducing wash time and the amounts of water and/or electric power that are used to wash the laundry.

In addition, it is not necessary to purchase a separate and/or dedicated washing machine for washing baby clothing for sanitary purposes, minimizing additional expense for purchasing a separate washing machine.

The weight of the present washing machine increases because the general type tub is at the upper portion of the washing machine. This arrangement may attenuate vibrations that occurs when a drum washing operation is performed.

When the general type tub is at the upper portion of the washing machine, a support structure configured to support the drum type tub below the general type tub may also support the general type tub. Therefore, it is not necessary to install and/or include a separate support structure to support the general type tub.

A water pipe is between the general type tub and the drum type tub, and a check valve is in the water pipe. Thus, water in the general type tub may be sent or transferred from the general type tub to the drum type tub by opening the check valve as necessary and/or desired, thereby recycling water at the time of a washing and/or rinsing operation.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
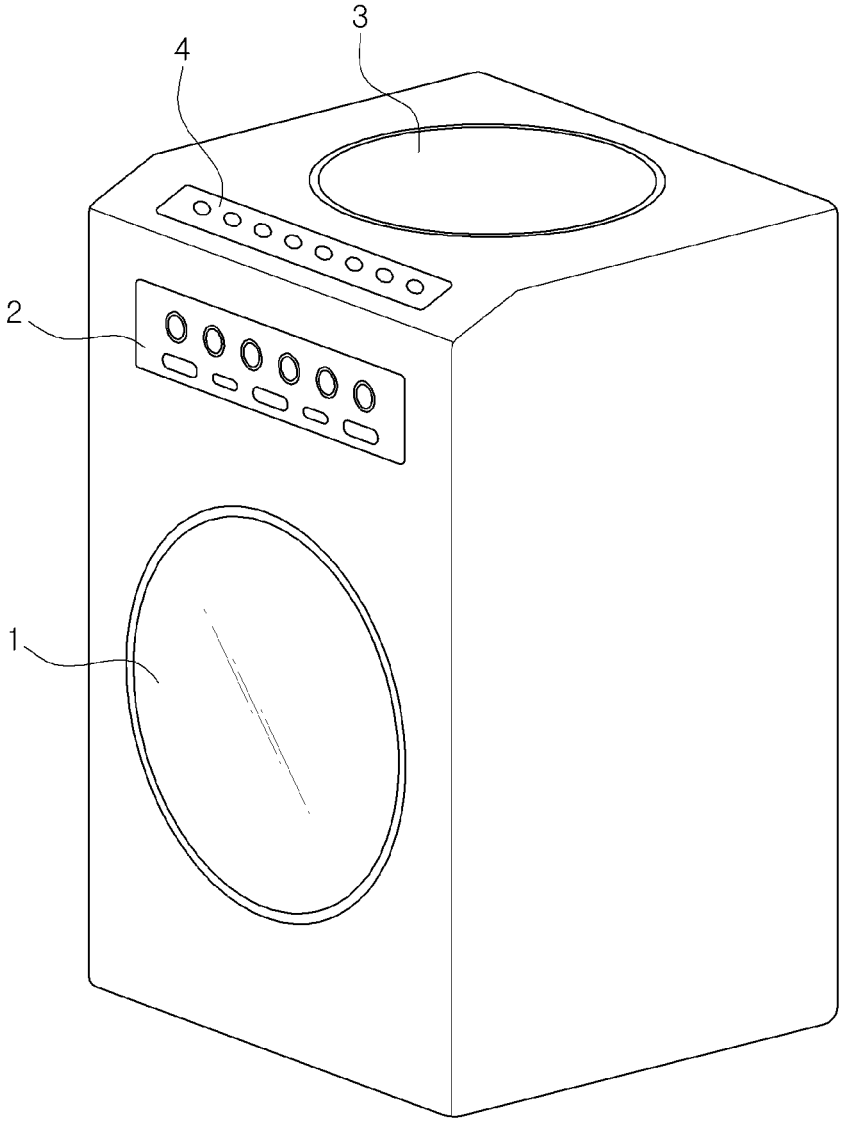
FIG. 1 is a view illustrating an external appearance of an exemplary dual washing machine according to the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, one or more exemplary embodiments according to the present disclosure will be described in detail with reference to the accompanying drawings. Various configurations of the present disclosure, and operations and/or effects according to the configurations of the present disclosure, will be clearly understood by the detailed description below.

It should be noted that the drawings are schematically provided and not necessarily to scaled. The relative dimensions and ratios of the parts illustrated in the drawings may be exaggerated or reduced in size for clarity and convenience in the drawings, and the dimensions are only examples without limitation. In the following description, the same elements will be designated by the same reference numerals although the elements are illustrated in different drawings, and a detailed explanation of known related constitutions may be omitted so as to avoid unnecessarily obscuring the subject matter of the present disclosure.

Exemplary embodiments of the present disclosure show ideal examples of the present disclosure. Accordingly, the exemplary embodiments shown in the drawings are expected to be changed in various ways. Therefore, the exemplary embodiments are not limited to specific configurations in the drawings, and may be changed to have various shapes and/or arrangements by manufacturing.

FIG. 1 illustrates an external appearance of a dual washing machine according to the present disclosure.

As illustrated in FIG. 1, a dual washing machine according to the present disclosure includes a drum type tub 1 at or in a lower portion of a main body and/or case, and a general type tub 3 at or in an upper portion of the main body and/or case. The drum type tub 1 is generally at the same position where the drum washing machine in the related art is installed, and the general type tub 3 may beat a portion where an upper portion of the drum washing machine in the related art is installed (e.g., above an upper portion of the drum type tub 1). Furthermore, the drum type tub 1 may also be (known as) a front-loading drum (and surrounding tub). The general type tub 3 may also be (known as) a top-loading drum (and surrounding tub).

In the dual washing machine according to the present disclosure, a drum washing control panel 2 for controlling drum washing, rinsing and/or spin-drying options is on a front surface of the upper portion of the main body and/or case, and a general washing control panel 4 for controlling general washing, rinsing and/or spin-drying options is on an top surface of the main body and/or case.

The dual washing machine according to the present disclosure includes both the drum type tub 1 and the general type tub 3, having control panels for each washing option and/or each tub. Therefore, a user may select any option from the drum washing options and/or the general washing options using the respective control panels. Alternatively, a user may wash the laundry with options for both tubs. However, in some exemplary embodiments, both types of washing options (e.g., options for general and drum tubs) may be controlled by a single control panel.

Figure 2:
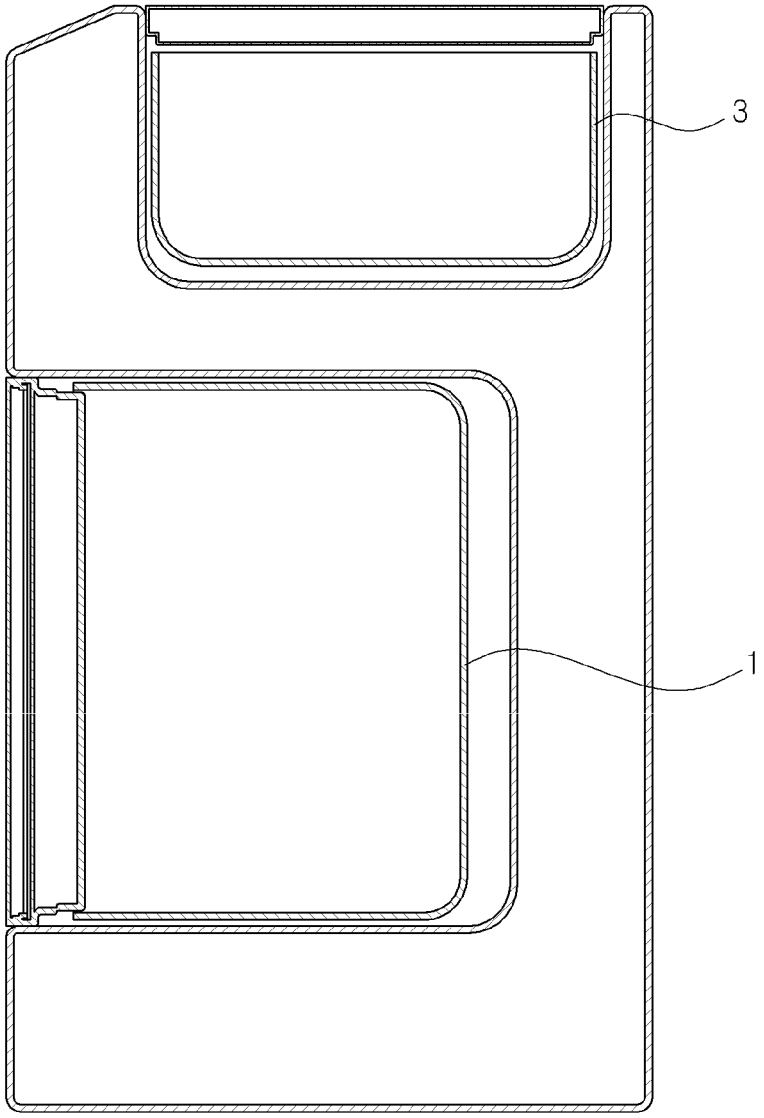
FIG. 2 is a view illustrating an exemplary inner tub of the washing machine according to the present disclosure.

FIG. 2 illustrates an exemplary interior tub designed for the dual washing machine according to the present disclosure.

As illustrated in FIG. 2, a space including the drum type tub 1 is at the lower portion of the main body and/or case, and a space including the general type tub 3 is at the upper portion of the main body and/or case.

The general type tub 3 is in an upper space that is usually an upper portion of a conventional drum washing machine. As a result, a space or a volume of the drum washing machine of the present disclosure may be increased. However, the present drum washing machine may have a more stable structure due to the weight of the general type tub 3 above the drum type tub 1. In the dual washing machine according to the present disclosure, the lower structure (e.g., including the drum type tub 1) may be more stably supported on a floor by the weight of the general type tub 3, thereby reducing vibrations and noise during drum washing, rinsing and/or spin-drying operation(s).

Figure 3:
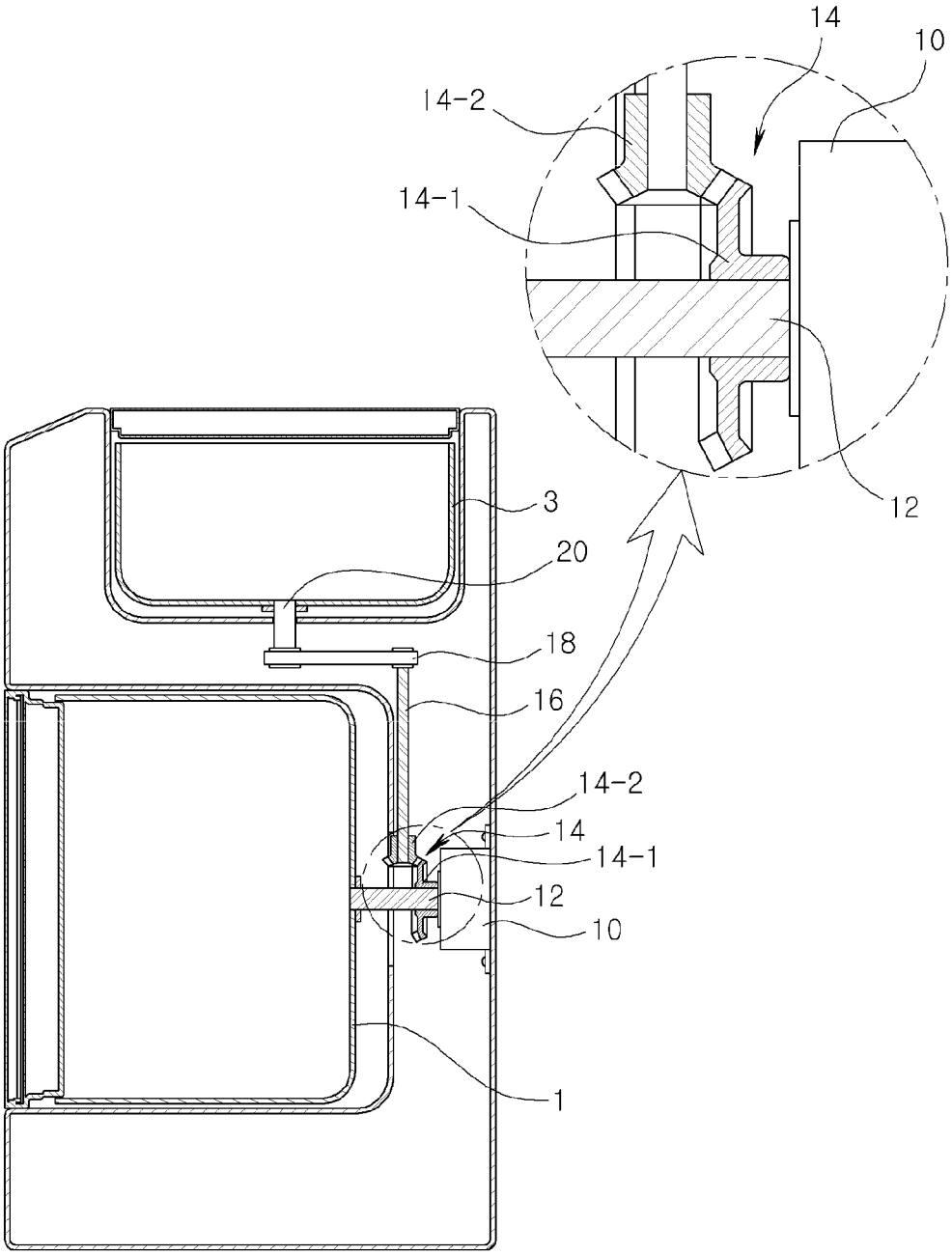
FIG. 3 is a view illustrating an exemplary structure in which a general type tub and a drum type tub of the washing machine according to the present disclosure are operated.

FIG. 3 illustrates an exemplary structure in which the general type tub and the drum type tub of the dual washing machine according to the present disclosure are operated.

The dual washing machine according to the present disclosure has a structure in which both the drum type tub 1 and the general type tub 3 are operated by a single motor.

Referring to FIG. 3, the drum type tub 1 is connected to a rotation shaft 12, and is the drum type tub 1 rotates when the rotation shaft 12 is rotated by a motor 10. The motor 10 may rotate shaft 12 directly. A rotation conversion unit 14 configured to convert a rotation in a first direction into a rotation orthogonal (e.g., the first direction) to the rotation shaft 12 of the motor 10.

The rotation conversion unit 14 may be configured as a bevel gear. The bevel gear 14 includes one or more (e.g., a pair of) ring gears 14-1 and one or more pinion gears 14-2. The ring gear 14-1 is connected to the rotation shaft 12, and the pinion gear 14-2 is connected to or integral with an end of a vertical rotation shaft 16.

When the ring gear 14-1 rotates around the rotation shaft 12, the pinion gear 14-2 that engages with the ring gear 14-1 rotates in a direction orthogonal to the rotation shaft 12, to rotate the vertical rotation shaft 16.

A power transmission unit, which includes a belt 18 and/or the like (e.g., a wheel at the end of 16 opposite from the pinion gear 14-2, a wheel at an end of shaft 20 opposite the drum type tub 3, either of which may have perpendicular and/or parallel ridges and/or grooves to increase the surface area and/or force in which the belt 18 (which may have matching and/or mating grooves or ridges) drives the shaft 20, is connected to at other end of the vertical rotation shaft 16 (e.g., an upper end and/or end opposite from the pinion gear 14-2), and when the vertical rotation shaft 16 rotates, the belt 18 also rotates. Then, a rotation shaft 20 of the general type tub, which is connected to the other portion of the belt 18, is rotated, the general type tub 3 is operated.

In other exemplary embodiments, the dual washing machine according to the present disclosure may use two or more (e.g., several) bevel gears instead of the belt, and may operate two types of tubs using a single motor.

The dual washing machine may include a first bevel gear 14, configured to convert a rotation in a first direction into a rotation in a second direction orthogonal to the first direction (e.g., that of the rotation shaft 12), a second bevel gear (not illustrated) configured to convert the rotation in the second direction into a rotation in a third direction orthogonal to the second direction (e.g., that of the shaft 16 and/or rotation shaft 20, which may be the same as the first direction), and a third bevel gear (not illustrated) configured to convert the rotation in the third direction (e.g., of the second bevel gear and/or the first bevel gear 14) into a rotation in a direction of the second bevel gear (e.g., around the shaft 20). The second bevel gear may be on or connected to the rotation shaft 20 of the general type tub 3. The third bevel gear may be on the vertical rotation shaft 16, and another rotation shaft (not illustrated) may be between the second bevel gear and the third bevel gear. Alternatively, the second bevel gear may be on or connected to the rotation shaft 20 of the drum type tub 1. The third bevel gear may be on the vertical rotation shaft 16, and another rotation shaft (not illustrated) may be between the second bevel gear and the third bevel gear.

As described above, the dual washing machine according to the present disclosure may rotate one or both of the two tubs using a single motor. A microprocessor that controls operations of the dual washing machine according to the present disclosure, controls the rotation shaft of each of the tubs, so that the drive power of the motor is transmitted or not transmitted to the rotation shaft of each of the tubs.

Figure 5:
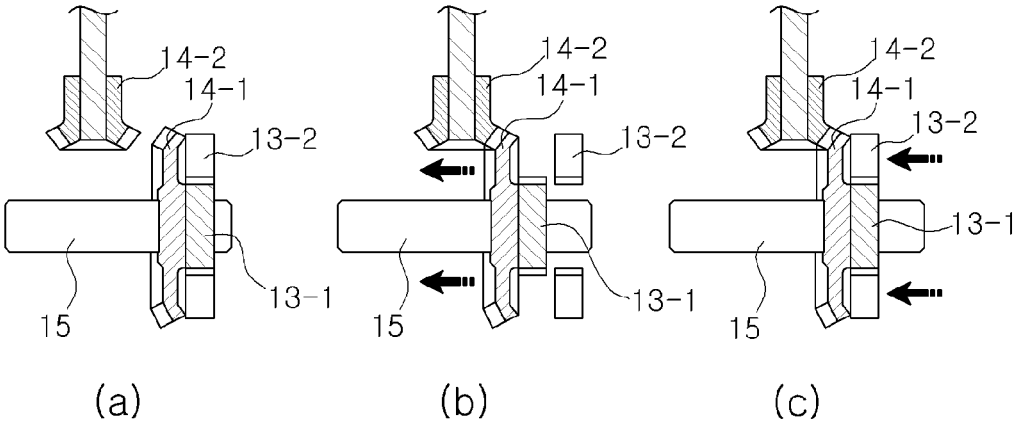
FIG. 5 is a view illustrating a check valve between the general type tub and the drum type tub of the washing machine according to the present disclosure.

FIG. 5 illustrates one or more other exemplary embodiments of the dual washing machine according to the present disclosure, and illustrates exemplary gear coupling structures for operating the general type tub and the drum type tub.

Referring to FIG. 5, FIG. 5(*a*) illustrates a gear coupling structure in which only the drum type tub is operated, FIG. 5(*b*) illustrates a gear coupling structure in which only the general type tub is operated, and FIG. 5(*c*) illustrates a gear coupling structure when the drum type tub and the general type tub are simultaneously operated.

Specifically, a first gear 13-1 is attached to one side (e.g., the back side or surface) of the ring gear 14-1, and the ring gear 14-1 and the first gear 13-1 may move integrally along a central shaft 15 (which may correspond to shaft 12 in FIG. 3). A second gear 13-2 that at a predetermined distance or interval from the central shaft 15 is movable in a horizontal direction (e.g., along the central shaft 15). One side or end of the central shaft 15 is connected to the motor 10, and another side or end of the central shaft 15 is connected to and/or integral with the rotation shaft 12 through the second gear 13-2. The second gear 13-2 is connected to the rotation shaft 12, such that the rotation shaft 12 is rotated when the second gear 13-2 is rotated.

When the ring gear 14-1 and the first gear 13-1 are at the right side along the central shaft 15, the ring gear 14-1 is separated from the pinion gear 14-2, and the first gear 13-1 is coupled to the second gear 13-2. Thus, the rotational force from the motor is transmitted to only the second gear 13-2. A clutch (not shown) may move shaft 15, the ring gear 14-1 and/or the first gear 13-1 into place so that motor 10 can rotate the shaft 12 connected to drum type tub 1. As a result, only the drum type tub connected to the rotation shaft 12 is operated (see FIG. 5A).

As illustrated in FIG. 5(*b*), when the ring gear 14-1 and the first gear 13-1 are moved to the left side along the central shaft 15 (e.g., by the clutch), the ring gear 14-1 is coupled to the pinion gear 14-2, and the first gear 13-1 is separated from the second gear 13-2. Thus, rotational force of the motor is transmitted to only the pinion gear 14-2 through the ring gear 14-1. As a result, only the general type tub is operated (see FIG. 5(*b*)).

As illustrated in FIG. 5(*c*), when the second gear 13-2 is moved to the left side in the horizontal direction with the central shaft 15 (e.g., by the clutch), the ring gear 14-1 and the pinion gear 14-2 are coupled to each other, and the first gear 13-1 and the second gear 13-2 are coupled to each other. As a result, rotational force of the motor is simultaneously transmitted to the pinion gear 14-2 and the second gear 13-2, and the drum type tub 1 and the general type tub 3 are simultaneously operated (see FIG. 5(*c*)).

When the second gear 13-2 returns to the original position, and the ring gear 14-1 and the first gear 13-1 are moved to the right side along the central shaft 15, the rotational force of the motor is transmitted to the second gear 13-2 alone, as illustrated in FIG. 5(*a*).

The coupling structures of the gears are changed based on the movements of the gears depending on the position and/or configuration of a part such as a clutch that transmits rotational force of the motor to one or both rotation shafts 12 and/or 16. Thus, the drum type tub and the general type tub may be operated individually or simultaneously.

Figure 4:
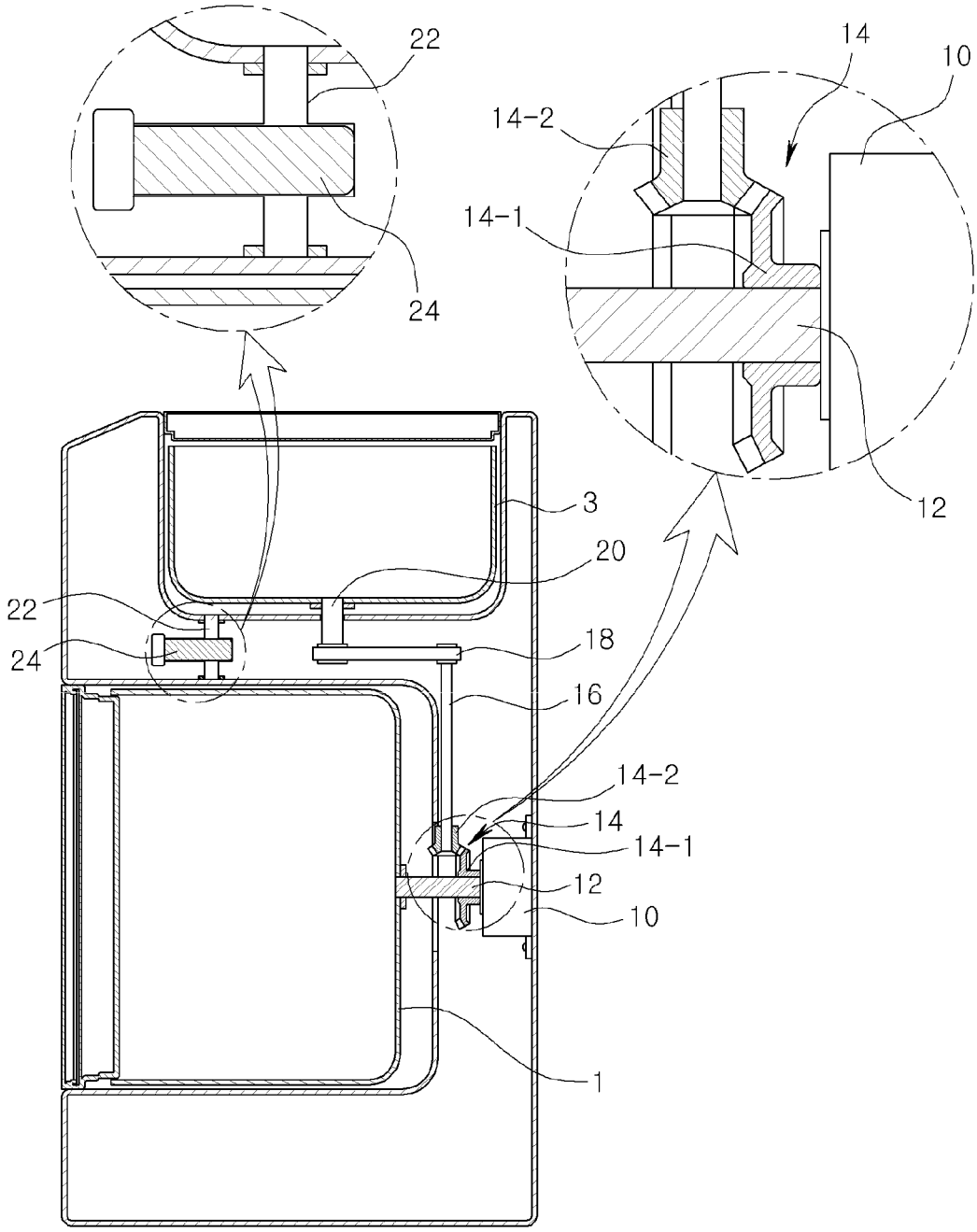
FIG. 4 is a view illustrating exemplary gear coupling structures for operating the general type tub and the drum type tub.

FIG. 4 illustrates an exemplary check valve between the general type tub and the drum type tub of the washing machine according to the present disclosure.

A water pipe 22 is connected between the general type tub 3 and the drum type tub 1, and a check valve 24 is installed in the water pipe 22. Alternatively, the water pipe 22 comprises upper and lower sections, wherein the upper section is connected to the general type tub 3 and an input to the check valve 24, and the lower section is connected to the drum type tub 1 and an output of the check valve 24.

The check valve 24 is turned on/off by the microprocessor to allow water in the general type tub 3 to flow into the drum type tub 1, or to block water in the general type tub 3 from flowing into the drum type tub 1. The check valve 24 may be opened as necessary and/or desired, so that water (e.g., relatively clean water from a rinsing operation) in the general type tub 3 may be used again in the drum type tub 1 (e.g., for a washing and/or rinsing operation).

A configuration in which the drum type tub is at or in the lower portion of the main body and/or case, and the general type tub is at or in the upper portion of the main body and/or case of the washing machine, has been described in the exemplary embodiments of the present disclosure. Alternatively, the drum type tub may be installed at or in the upper portion, and the general type tub may be installed at or in the lower portion, and the positions of the tubs may vary depending on the design.

Although exemplary embodiments of the present disclosure are described above with reference to the accompanying drawings, those skilled in the art would understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims described below, not the detailed description, and it should be construed that all of changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

a front-loading tub in a main body and/or case of the washing machine;

a top-loading tub in the main body and/or case;

a motor configured to transmit a rotational force;

a rotation conversion unit configured to convert a rotation in a first direction into a rotation orthogonal to a rotation shaft of the motor;

a vertical rotation shaft configured to be rotated by the rotation conversion unit; and a power transmission unit connected to the vertical rotation shaft and configured to rotate a rotation shaft of the top-loading tub.

2. The washing machine of claim 1, wherein the front-loading tub is at or in a lower portion of the main body and/or case, and the top-loading tub is at or in an upper portion of the main body and/or case.

3. The washing machine comprising:

a front-loading tub in a main body and/or case of the washing machine;

a top-loading tub in the main body and/or case;

a motor which transmits rotational force;

a first rotation conversion unit configured to convert a rotation in a first direction into a rotation orthogonal to a rotation shaft of the motor;

a second rotation conversion unit configured to convert a rotation in a second direction into a rotation orthogonal to a rotation shaft of the top-loading tub; and a third rotation conversion unit configured to convert a rotation direction of the first rotation conversion unit into a rotation direction of the second rotation conversion unit.

4. The washing machine of claim 3, wherein the first, second, and third rotation conversion units each comprise a bevel gear.

5. The washing machine of claim 1, further comprising a first control panel that controls a general washing operation on an upper and/or top surface of the main body and/or case, and a second control panel that controls a drum washing operation on a front surface of an upper portion of the main body and/or case.

6. The washing machine of claim 1, further comprising a single control panel configured to control general washing operations and drum washing operation on the main body and/or case.

7. The washing machine of claim 1, wherein the rotation conversion unit includes a ring gear on a central shaft connected to the motor, a first gear attached to one side of the ring gear, a second gear connected to the rotation shaft of the motor and coupled to the first gear.

8. The washing machine of claim 7, further comprising a pinion gear coupled to the ring gear, configured to rotate in a direction orthogonal to the rotation shaft of the top-loading tub.

9. The washing machine of claim 8, wherein the top-loading tub is configured to rotate when the ring gear and the first gear integrally move along the central shaft, the first gear and the second gear are coupled to each other, and the ring gear and the pinion gear are separated from each other.

10. The washing machine of claim 8, wherein the front-loading tub is configured to rotate when the ring gear and the first gear move along the central shaft, the first gear and the second gear are separated from each other, and the ring gear and the pinion gear are coupled to each other.

11. The washing machine of claim 9, wherein the second gear has a structure configured to move in a horizontal direction with the central shaft.

12. The washing machine of claim 9, wherein the top-loading tub and the front-loading tub simultaneously operate when the ring gear and the pinion gear are coupled to each other, and the second gear is coupled to the first gear.

13. The washing machine of claim 1, further comprising a water pipe connected between the top-loading tub and the front-loading tub.

14. The washing machine of claim 13, further comprising a check valve in or along the water pipe, configured to allow water in the top-loading tub to flow into the front-loading tub and/or block water in the top-loading tub from flowing into the front-loading tub.

15. The washing machine of claim 1, wherein the motor is configured to rotate the top-loading tub and the front-loading tub.

16. The washing machine of claim 15, further comprising a microprocessor configured to control a rotation of each of the general and front-loading tub and the general and front-loading tubs.

17. The washing machine of claim 15, wherein a location and/or weight of the top-loading tub prevents vibrations and noise of the front-loading tub.

18. The washing machine of claim 1, wherein the power transmission unit comprises a belt.

* * * * *